United States Patent [19]

Foege et al.

[11] 4,379,611

[45] Apr. 12, 1983

[54] CONNECTOR WITH LOW FORCE SOCKET CONTACT HAVING AN INTEGRAL HOOD

[75] Inventors: Ronald E. Foege, Mission Viejo; Leslie L. Kerek, Irvine, both of Calif.

[73] Assignee: Hughes Aircraft Company, Culver City, Calif.

[21] Appl. No.: 203,180

[22] Filed: Nov. 3, 1980

[51] Int. Cl.[3] ..... H01R 13/40; H01R 13/12

[52] U.S. Cl. ..... 339/217 S; 339/258 P

[58] Field of Search ..... 339/256 R, 258 R, 258 P, 339/217 S

[56] References Cited

U.S. PATENT DOCUMENTS

| | | | |
|---|---|---|---|
| 3,538,489 | 11/1970 | Bennett et al. . | |
| 3,569,900 | 3/1971 | Uberbacker . | |
| 3,609,640 | 9/1971 | Longenecker . | |
| 3,663,931 | 5/1972 | Brown . | |
| 3,697,925 | 10/1972 | Henschen . | |
| 3,701,967 | 10/1972 | Kreutter | 339/256 R X |
| 3,824,557 | 7/1974 | Mallon | 339/258 R |
| 3,853,389 | 12/1974 | Occhipinti | 339/258 R X |
| 3,874,763 | 4/1975 | Hoover . | |
| 3,963,302 | 6/1976 | Gourley . | |
| 3,980,385 | 9/1976 | Hirokawa et al. . | |
| 3,986,766 | 10/1976 | Sochor | 339/217 S X |
| 4,174,877 | 11/1979 | Foederer . | |
| 4,226,499 | 10/1980 | Bauerle . | |

FOREIGN PATENT DOCUMENTS

| | | | |
|---|---|---|---|
| 2036990 | 7/1969 | Fed. Rep. of Germany | 339/258 R |

*Primary Examiner*—Joseph H. McGlynn

*Attorney, Agent, or Firm*—L. B. Sternfels; W. J. Bethnum; A. W. Karambelas

[57] ABSTRACT

A one-piece socket contact (20) for removable emplacement within a cavity (56) of a receptacle connector (10) comprises a pair of tuning-fork shaped tapered tines (34), an upstanding support (40) and a common connection there amongst to form therefrom a generally parallel cantilevered tripartite tine-support structure. A hood (48) is provided with a bevelled, oval-shaped opening (50) which overlies the tines to compensate for mismatch between an engaging pin contact with the socket contact. Compensation is afforded either by the elongated major axis of the oval-shaped opening or by the ability of the hood to deflect along the opening's minor axis. The contact is retained by engagement between a retention tab (54) and an opening (70). An anti-flotation engagement occurs between spurs (30) and a cavity wall.

15 Claims, 6 Drawing Figures

Fig. 4.
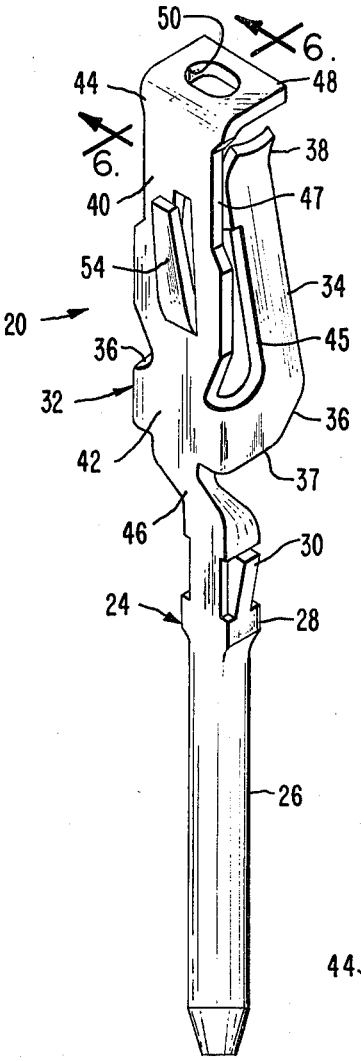
Fig. 5.
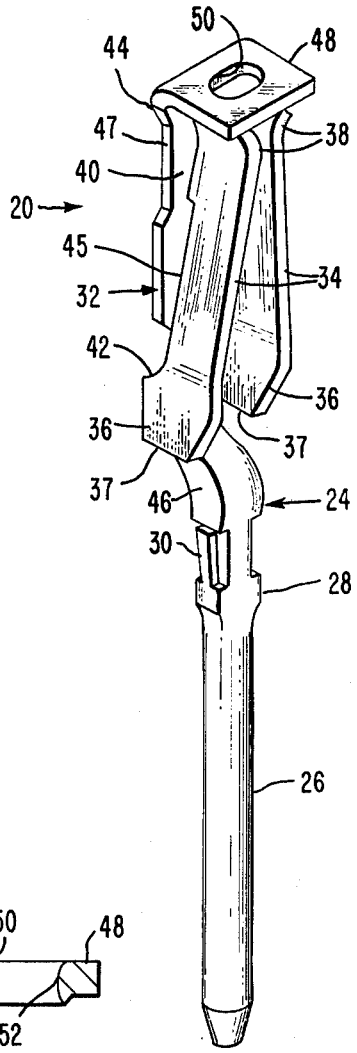
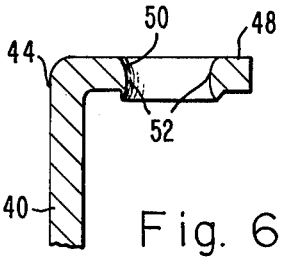
Fig. 6.

CONNECTOR WITH LOW FORCE SOCKET CONTACT HAVING AN INTEGRAL HOOD

TECHNICAL FIELD

The present invention relates to a socket contact particularly useful with printed circuit connectors.

BACKGROUND OF THE INVENTION

Printed circuit connectors are conventionally soldered or otherwise affixed to electrical circuitry. When repair or replacement of a contact was required, for example due to damage thereto, it was not economical, if not feasible, to replace the damaged contact and, therefore, it was customary to dispose of the entire connector. Specifically, all the soldered or other terminal connections had to be disengaged because the complete connector assembly had to be removed from the printed circuit board or flex circuit. In addition, the connector sometimes would break, in part because relatively high forces were required to remove the contacts from the connector body.

Further problems arise in some styles of socket contacts which are circular in design. Such circular contacts are retained by a C-ring at the terminating end of the connector, which permits the contact to float and rotate within the connector body and, thus, to stress the soldered termination joint with the flex circuit or printed circuit board. The joints consequently became weakened and failed. In addition, because of the circular beam construction of the tines of the mating contact, engagement and separation forces are relatively high and such forces are increased because of mating misalignment between the socket contact and the pin contact.

Various other designs have been suggested as evidenced by those disclosed in U.S. Pat. Nos. 3,538,489; 3,569,900; 3,609,640; 3,697,925; 3,874,763; 3,963,302; and 3,980,385. These constructions present a primary difficulty in that they are rear release connectors where it is difficult, if not impossible, to remove a single connection from a printed wiring board or flexible printed wiring. In addition, full support of the contact in the connector body is not insured, inasmuch as the contacts are designed for rear removal, and the contacts may move through rotation or flotation within the connector body to create strains on the joint.

Other constructions, such as are illustrated in U.S. Pat. Nos. 3,663,931; 3,701,967; 3,853,389; and 4,174,877 present similar and/or other difficulties. As before, their retention within the connector body may result in flotation or slight rotation, thereby giving rise to strain at the joint. However, they avoid the problem of the above-noted rear release contacts in that they are capable of being removed from the front or mating face of the connector. Nevertheless, this advantage presents other disadvantages, for example, in their ability to receive a mating pin contact without generating high engagement and separation forces, especially due to mating misalignment. When the contacts are constructed from more than a single piece, their cost of construction rises, as requiring a number of separate forming operations, as well as several emplacement steps when the contacts are inserted into a connector body.

SUMMARY OF THE INVENTION

These and other problems are overcome by the present invention, which comprises a single piece socket contact which is insertable in and removable from a connector body at its front or mating face, without disturbing other contacts and their connections already in the connector body. Specifically, the socket contact comprises a pair of tapered tines having a tuning fork configuration which are secured to an upstanding support to form therewith a generally parallel cantilevered tripartite structure. A hood attached to the upstanding support extends generally over the ends of the tines and is provided with a bevelled, oval-shaped opening whose minor axis lies in the path of deflection of the support and whose major axis lies in a plane passing through the tines. Thus, the elongated opening provided by the major axis and the deflectable nature of the hood compensates for any mismatch of a mating pin contact with the socket contact.

The support and the tapered tines define a configuration having a preferred rectangular cross-section, and a terminal end extending from the support also is provided with a similar rectangular configuration, both of which fit within corresponding parts of a rectangular shaped cavity in the connector body to provide a double anti-rotation engagement of the contact within the connector body. A retention tab, configured as a tapered beam, extends from the support into an opening in a side wall of the connector body to enable easy retention and release of the contact from the connector body. Spurs at the terminal portion also extend into engagement with the connector body primarily to prevent flotation of the contact within its cavity. The lower parts of the tines provide surfaces which abut against ledges in the connector body cavity to provide, with the retention tab and the spurs, a solid securement of the contact within the cavity.

Several advantages are derived from the above construction. One or more socket contacts may be easily and independently separated from the connector's front face, without requiring that the entire connector be disposed of, or that the connections with other contacts be disturbed. Lower or reduced mating forces between connectors are possible primarily due to the tapered tuning fork configuration as well as to the bevelled, oval-shaped opening in and deflection of the hood. Reduced stress on printed circuit board and flex circuit soldered termination joints is encouraged by the contact anti-float design.

Other aims and advantages as well as a more complete understanding of the present invention will appear from the following explanation of an exemplary embodiment and the accompanying drawings thereof.

BRIEF DESCRIPTION OF THE DRAWINGS

FIGS. 4 and 5 are perspective views from different directions of the socket contact; and FIG. 6 is a view of the closed entry hood of the socket contact taken along lines 6—6 of FIGS. 4 and 5.

DETAILED DESCRIPTION OF THE INVENTION

Figure 1:
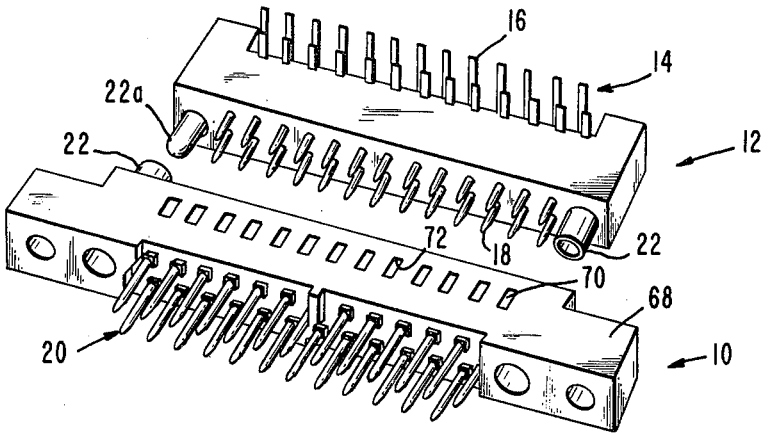
FIG. 1 is a perspective view of mateable plug and receptacle connectors, in which receptacle connector inventive socket contacts are used.

As shown in FIG. 1, a receptacle connector 10 is positioned adjacent to a right angle plug connector 12 in readiness for mating engagement therebetween. Plug connector 12 incorporates a plurality of right angle pin contacts 14 which are of conventional construction and which are conventionally secured within the plug connector. The pin contacts include terminal ends 16, which are adapted to be secured to a multi-layered printed circuit board or flexible printed wiring or the like, and pin contact ends 18 which are disposed to engage socket contacts 20 in receptacle connector 10. Round guide pins and guide sockets 22 in the plug and receptacle connectors assure proper mating between the pin and socket contacts.

As best shown in FIGS. 2–5, each socket contact 20 include a terminal portion 24 having a terminal end 26 which may be configured in any suitable manner depending upon the specific connection to be made. As shown, terminal end 26 is designed for dip solder termination; however, other configurations may be used for flex circuit termination or solder cup termination. Terminal portion 24 is completed by an intermediate section 28 of rectangular cross-section. Extending from opposite sides of section 28 are a pair of spurs 30 formed, for example, by upsetting metal from section 28.

Joined to terminal portion 24 is a body portion 32 comprising a pair of tapered tines 34 respectively having first and second ends 36 and 38, an upstanding support 40 also having first and second ends 42 and 44, and a common connection among first ends 36 of the tines and first end 42 of the support to form a generally parallel cantilevered tripartite tine-support structure. First ends 36 terminate respectively in flat surfaces 37, used as abutment surfaces. A bent interconnection 46 joins body portion 32 at the first end of upstanding support 40 to rectangular intermediate section 28 of terminal portion 24.

As shown, tines 34 are bent inwardly at their first ends 36 and flaired outwardly at their second ends 38 to form a tuning-fork configuration. Thus, tines 38 are capable of deflecting in a path towards and away from one another upon contact with a pin contact, such as by one pin end 18 shown in FIG. 1. To achieve any desired low insertion force of a mating pin contact from improved deflection characteristics of the tines, the thickness and width of the tines may be suitably varied, e.g., as shown by cut-away portions 45. Further, support 40 is deflectable in a path towards and away from the tines generally perpendicular to the path of deflection of the tines. Similar cut-away portions 47, and reduced thickness may be incorporated in support 40 to vary its beam-bending characteristics.

A hood 48 is joined to second end 44 of upstanding support 40 and extends generally perpendicularly therefrom, and over second ends 38 of tines 34. Thus, the hood acts as an elongated closed entry. Placed within the hood is an oval-shaped opening 50 whose minor axis lies in a plane of the path of deflection of the support and whose major axis lies in a plane passing through the tines and the path of their deflection. As best shown in FIG. 6, opening 50 is bevelled at 52 to minimize drag on a pin 18 of pin contact 14 when engaged therewith. In addition, any misalignment of pin 18 with socket contact 20 is compensated for by the larger major axis of oval-shaped opening and by the capability of the hood to deflect in the direction of the minor axis of the opening. Thus, the force of insertion of pin 18 with tines 34 is greatly reduced.

Socket contact 20 is completed by a retention tab 54, which is configured as a tapered beam, and which extends from upstanding support 40 intermediate its ends 42 and 44 and outwardly from tines 34.

Figure 2:
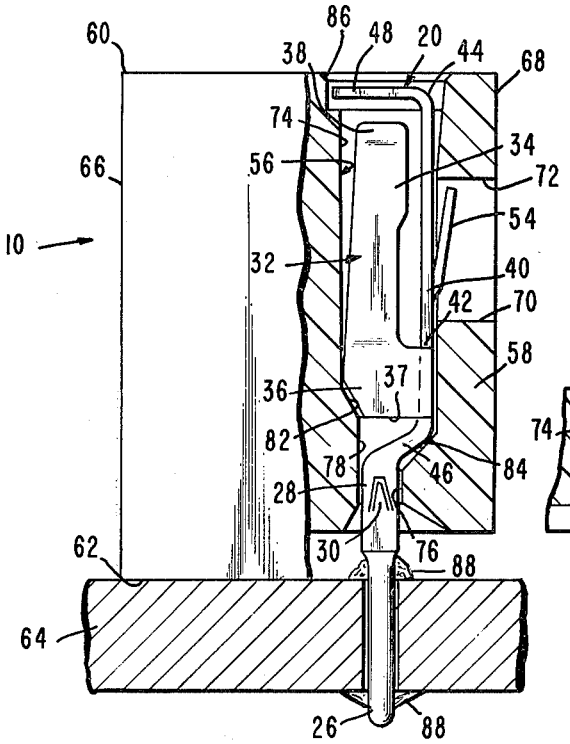
FIG. 2 is a side elevational view in partial section of a receptacle connector with one inventive socket contact placed therein.
Figure 3:
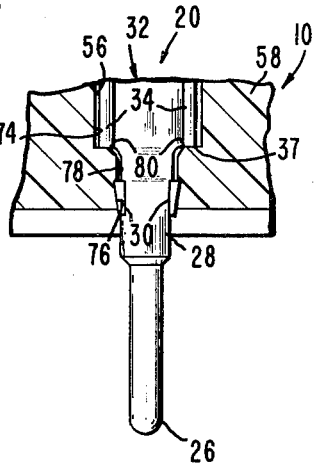
FIG. 3 is a front view in cross-section of the receptacle connector and contact placed therein.

Receptacle connector 10 is configured to receive a plurality of socket contacts 20 within cavities 56 in its connector body 58. As best shown in FIGS. 2 and 3, the connector body is formed of a dielectric material and has a front face 60, which is engageable with plug connector 12, and a rear face 62, which is adapted to come into contact with and be secured, for example, to a printed circuit board or flex circuit 64. The exterior surface of the connector body is completed by a pair of sides 66 and 68. Openings 70 extend through side 68, and include a plurality of forward or front abutment surfaces 72.

Each of contact-receiving cavities 56 extend between front and rear faces 60 and 62 of connector 10 and comprise a pair of serially extending walled sections 74 and 76 respectively having larger and smaller generally squared or rectangular cross-sections, with a transition section 78 connecting the walled sections. Larger wall section 74 opens at front face 60 while smaller wall section 76 opens at rear surface 62. Openings 70 enters cavity 56 into larger wall section 74. Transition section 78 includes a pair of opposing ledges 80 and a pair of inclined ramps 82 and 84 which are perpendicularly placed with respect to the ledges.

Accordingly, when socket contact 20 is inserted within cavity 56, retention tab 54 is depressed against the inner walled surface of section 74 until it snaps within opening 70 to prevent removal of the contact specifically through engagement between tab 54 and forward abutment surface 72 of opening 70. At the same time spurs 30 on rectangular intermediate section 28 dig into the surrounding walls of smaller wall section 76 to prevent flotation of the contact within the cavity. A secure rearward support of the contact is afforded by contact of abutment surfaces 37 which contact ledges 80 in transition cavity section 78. When in place within cavity 56, hood 48 of contact 20 closes the opening of the cavity at 86. Inasmuch as a combination of tines 34 and support 40 are generally rectangular in cross-section and have generally the same dimension as that of the rectangular cross-section of larger walled section 74, and because smaller rectangular intermediate section 28 fits similarly within smaller rectangular wall section 76, contact 20 is incapable of rotation within cavity 56.

After insertion of the contact within the connector, a printed circuit board or flex circuit 64 may be soldered at 88 in one or two locations to form a secure electrical joint. In the event that it is necessary to remove any contact 20 from connector 10, it is necessary only that the relevant soldered connector at 88 be disconnected, that retention tab 54 be depressed inwardly and out of engagement with forward abutment surface 72, and that the contact be pushed out of the connector's cavity, without damage to any other contacts or their soldered joints with the printed circuit board or flex circuit.

While square or rectangular cross-sections of the socket contact and the cavity are preferred, it will be appreciated that any non-circular configuration, or any other arrangement which will prevent rotation of the contact within the cavity, may be employed.

Although the invention has been described with reference to a particular embodiment thereof, it should be realized that various changes and modifications may be made therein without departing from the spirit and scope of the invention.

What is claimed is:

1. A socket contact for removable emplacement within a cavity in a connector body comprising:

means having an opening for receiving a pin contact and including at least one spring member normally positioned in the opening and movable out of the opening when contacted by the pin contact;

a resilient support movable generally perpendicularly to the movement of said spring member; and a hood shielding said opening means and coupled to said resilient support, said hood having means defining a non-circular opening larger than the pin contact and having larger and smaller dimensions, with the larger dimension extending generally parallel to the direction of the spring member movement to permit easy entry of the pin contact into electrical contact with said spring member even if the pin contact has an axis which is not centrally aligned with either of the openings, said hood being movable by the pin contact in a direction generally parallel with the smaller dimension of said non-circular opening means through flexure of said resilient support.

2. A contact according to claim 1 in which said opening means comprises an oval-shaped opening.

3. A contact according to claim 1 or 2 in which at least said one spring member comprises a pair of tapered tines facing one another and secured to said support at a first of their respective ends remote from said hood to provide a pair of abutments respectively at said first ends.

4. A contact according to claim 3 in which the thicknesses and widths of said support and said tines are varied to achieve specific beam-bending characteristics thereof.

5. A socket contact according to claim 1 in which at least said one spring member comprises a pair of tines respectively having first and second ends, and said support has first and second ends, and further comprising a common connection among said first ends of said tines and said support to form a generally parallel cantilevered tripartite tine-support structure.

6. A contact according to claim 5 in which the thicknesses and widths of said support and said tines are varied to achieve specific beam-bending characteristics thereof.

7. A contact according to claim 5 in which said tripartite structure is generally rectangular in cross-section.

8. A contact according to claim 5 in which said hood is joined to and generally extends perpendicularly from said second end of said support and over said second ends of said tines.

9. A contact according to claim 5 wherein said non-circular opening means has an oval-shaped configuration whose smaller dimension is a minor axis which lies in a plane common with the support movement, and whose larger dimension is a major axis which lies in a plane passing through the direction of the movement of said tines.

10. A contact according to claim 5 further comprising a pair of abutment surfaces respectively on said first tine ends for engagement with ledges in the connector body cavity.

11. A contact according to claim 5 in which said hood opening means is bevelled to minimize drag on the pin contact when engaged therewith.

12. A contact according to claim 11 further including a terminal portion extending from said common connection and away from said cantilevered tripartite structure, and spurs extending outwardly from said terminal portion for engagement with the connector body.

13. A contact according to claim 12 further including a retention tab, configured as a tapered beam, extending from said support towards said support second end and outwardly from said tines for engagement with the connector body.

14. A contact according to claim 12 in which said terminal portion at said spurs is generally rectangular in cross-section.

15. A printed circuit receptacle connector mateable with a plug connector comprising:

an elongated body of dielectric material having a front face engageable with the plug connector, a rear face and a pair of sides;

means defining a plurality of contact receiving cavities in said body extending between said front and rear faces and having openings at said front and rear faces and in one of said sides to form with said one side a forward abutment, each of said cavity means comprising a pair of serially extending walled sections respectively having smaller and larger generally rectangular cross-sections and a transition section connecting said walled sections with said larger enclosure opening at said front face and at said side and said smaller enclosure opening at said rear face, said transition section including a pair of opposing ledges and a pair of opposing inclined ramps perpendicularly placed with respect to said ledges;

a plurality of single-piece electrically conductive socket contacts placed respectively in said cavity means, each said contact comprising stamped and formed terminal and body portions, said terminal portion having a rectangular cross-section and extending through and in non-rotatable contact with said smaller walled cavity section, a pair of spurs facing towards said front body face and extending outwardly from said terminal portion into gripping engagement with said body material for axially retaining said contact tightly within said cavity means, said body portion including a back support having opposed ends and sides and connected at a first of said ends to said terminal portion and extending therefrom at the second of said ends towards said front body face, a retention tab extending outwardly from said back support and into the opening through said body side to latch with said abutment and to retain said contact in said cavity body, a pair of parallelly placed tuning-fork configured tapered tines extending towards said front body face and having surfaces facing said terminal portions and resting on said ledges, said tines being secured perpendicularly to said back support at said first end to form with said back support a generally rectangular cross-section to said body portion fittable in close contact with said larger enclosure; and a hood secured perpendicularly to said second end of said back support to cover said tines and to close the cavity opening at said front face, said hood having means defining an oval-shaped bevelled opening therein, with the major axis of said oval-shaped opening means lying generally parallel to a line extending from one to the other of said tines to permit easy entry of an off-axis mating pin contact into electrical contact with said tines, said hood being moveable by said mating pin contact in a direction along the minor axis of said oval-shaped opening means through flexure of said back support.

* * * * *